United States Patent [19]

Liebgott

[11] B 4,012,404

[45] Mar. 15, 1977

[54] PROCESS FOR PRODUCING HIGH-METHANE GAS

[75] Inventor: Helmut Liebgott, Bad Homburg, Germany

[73] Assignee: Metallgesellschaft Aktiengesellschaft, Frankfurt am Main, Germany

[22] Filed: Nov. 7, 1974

[21] Appl. No.: 521,985

[44] Published under the second Trial Voluntary Protest Program on March 23, 1976 as document No. B 521,985.

Related U.S. Application Data

[63] Continuation of Ser. No. 317,033, Dec. 20, 1972, abandoned.

[30] Foreign Application Priority Data

Jan. 3, 1972 Germany ..... 2200004

[52] U.S. Cl. ..... 260/449 M; 48/214 A; 48/197 R; 252/373; 260/449 S

[51] Int. Cl.[2] ..... C07C 27/06

[58] Field of Search ..... 48/214, 197 R; 260/449 M, 666 R; 252/373

[56] References Cited

UNITED STATES PATENTS

| | | | |
|---|---|---|---|
| 3,511,624 | 5/1970 | Humphries et al. | 260/449 M |
| 3,870,738 | 3/1975 | Yamamoto et al. | 260/449 M |

*Primary Examiner*—S. Leon Bashore
*Assistant Examiner*—George C. Yeung
*Attorney, Agent, or Firm*—Burgess, Dinklage & Sprung

[57] ABSTRACT

High-methane gas which can be used in place of natural gas is made by a. catalytically cracking liquid hydrocarbons with water vapor at elevated temperatures and pressures to produce a rich gas containing less than 15% hydrogen by volume;
b. cooling the rich gas to a temperature below 150° C thereby reducing the water vapor content thereof by condensation;
c. separating condensed water from the rich gas;
d. thereafter hydrogenating the carbon oxides in the gas by dividing same into two streams, one of the streams being preheated to a temperature of at least 250° C and then being introduced into the first catalyst layer of a hydrogenation zone containing two catalyst layers, the other of the streams being fed at the temperatures produced in cooling step (b) between the catalyst layers of the hydrogenation zone; and
e. scrubbing the product gas leaving the hydrogenation zone to remove carbon dioxide.

Preferably, the ratio of the two streams is adjusted such that the temperature rise in the second catalyst layer of the hydrogenation zone is less than 50° C and the product gas leaving the hydrogenation zone contains less than 1% hydrogen by volume.

3 Claims, 1 Drawing Figure

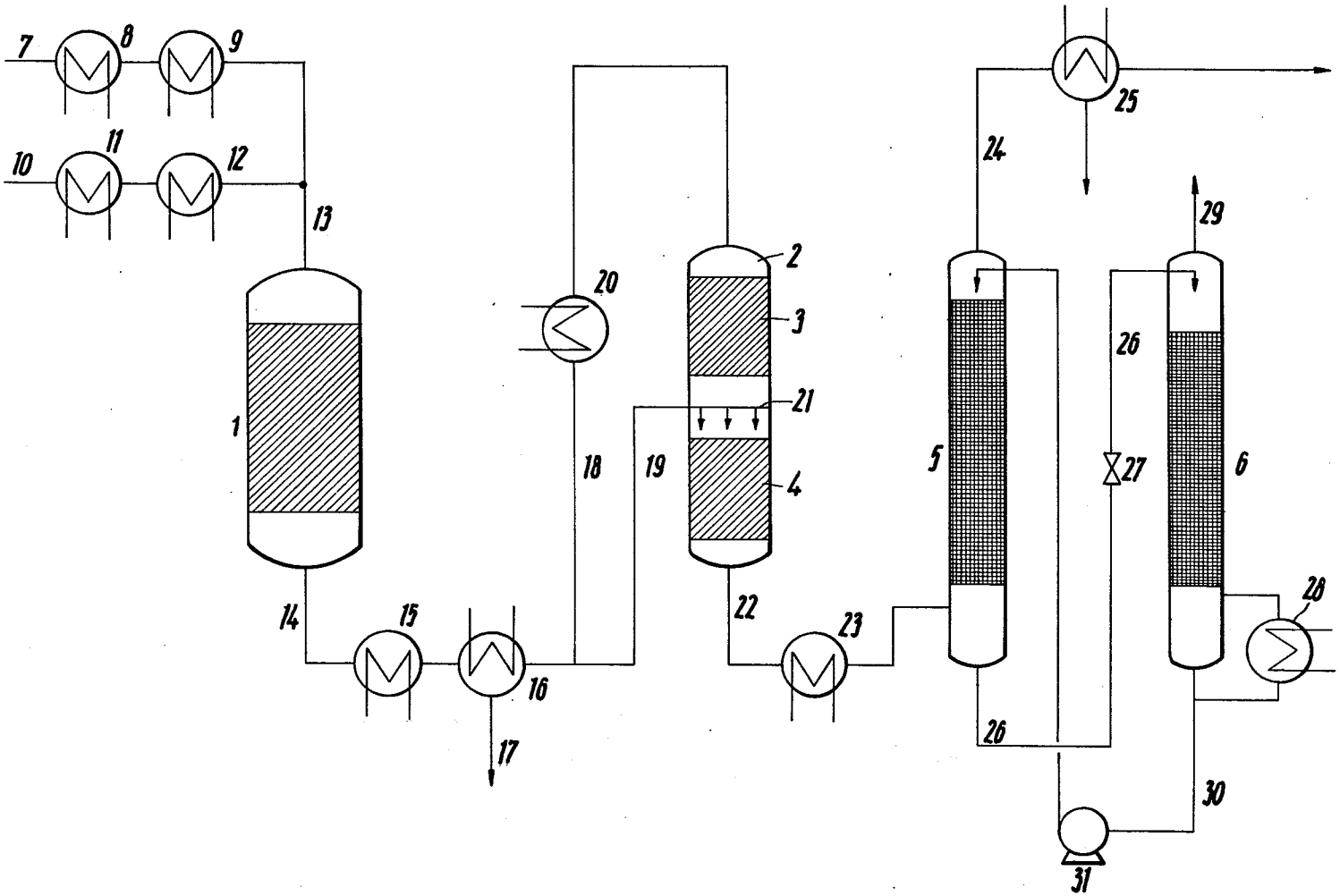
1
2
3
4
5
6
7
8
9
10
11
12
13
14
15
16
17
18
19
20
21
22
23
24
25
26
27
28
29
30
31

PROCESS FOR PRODUCING HIGH-METHANE GAS

This is a continuation of application Ser. No. 317,033, filed Dec. 20, 1972, now abandoned.

BACKGROUND

The use of natural gas as public utility fuel gas has had the advantage that in distributing pipe systems which are under relatively high pressures (about 30 kilograms per square centimeter absolute pressure), the natural gas containing more than 90% methane may be used to transport the highest possible calorific value per unit of volume. These supply systems are centrally fed from the sources of natural gas. In view of the large areas covered by these systems it is necessary to produce a synthetic natural gas from other fuels, particularly liquid fuels, in order to compensate for pressure fluctuations during times of high gas consumption or to supplement overloaded or exhausting sources of natural gas.

DAS No. 1,180,481 discloses a process in which evaporable liquid hydrocarbons are cracked on high-nickel catalysts at temperatures of about 450°C to produce a rich gas which has a relatively high methane content, contains relatively little carbon monoxide and has a much higher calorific value than coke oven gas, which was previously considered a standard supply gas.

The methane content of this rich gas can be increased by subjecting it to a further reaction on another catalyst at temperatures below 400°C whereby the hydrogen content is reduced by the hydrogenation of CO and $CO_2$.

DOS No. 1,645,840 discloses a process for methanating a rich gas, wherein the oxides of carbon are hydrogenated in two stages and at least in the first stage are hydrogenated in the presence of the water vapor which has not been reacted during the production of the rich gas. The rich gas leaving the reactor is cooled to a temperature above its dew point and is then catalytically reacted in the first methanation stage. Because of the high water vapor content the heat which is liberated during the methanation reaction results only in a moderate temperature rise of about 50°–60°C. Because water vapor is a product of the methanation reaction, the quantity of steam which is already present prevents a reaction of a considerable quantity of hydrogen with the oxides of carbon, and the temperature rise in the catalyst layer displaces the equilibrium in the undesired direction toward the starting substances. For this reason, in the second methanation stage, the inlet temperature is reduced and by a cooling below the dew point the water vapor content is reduced to such an extent that the carbon black limit defined by the Boudouard reaction is not reached during the further reaction.

It has been believed that the large quantity of water vapor must be carried along at least through the first methanation stage in order to hold down the temperature rise due to the hydrogenating reaction, to prevent a formation of carbon black by the Boudouard reaction.

On the other hand, the presence of water vapor involves considerable disadvantages. The relatively large vapor volume must be moved over the catalyst as a ballast material and tends to shift the equilibrium of the methanation reaction in the undesired direction. For this reason the vapor also reduces the rate of the methanation reactions so that, particularly in the first stage, only small space velocities are possible and correspondingly large quantities of catalyst are required. From among the large number of the so-called high-activity methanation catalysts, only those are suitable which are insensitive to the high concentration of water vapor in the gas to be reacted. Besides, between the two methanation stages the entire gas must be cooled to condense water vapor and must be reheated to the inlet temperature of the second methanation stage.

Plants for producing synthetic natural gas must handle gas at very high rates, and the high water vapor rates require uneconomically large heat exchangers, reactors, and quantities of catalysts.

DOS No. 1,545,463 discloses a process for producing a high-methane gas wherein evaporable hydrocarbons are initially cracked with 1.5–3 kilograms water vapor per kilogram of hydrocarbon on a catalyst which comprises nickel or cobalt on a magnesium silicate support to produce a rich gas having a relatively low water vapor content. The rich gas is subsequently methanated and for this purpose is first cooled to 200°–250°C. and passed over an indirectly cooled methanation catalyst. A single methanation stage is used to give an end product which when scrubbed to remove carbon dioxide contains more than 98% methane by volume. It has been found, however, that the process cannot be carried out on a large scale unless the operating conditions are controlled with very small tolerances.

To produce a gas which consists almost entirely of methane, the hydrogenation of carbon monoxide and carbon dioxide must be controlled so that the hydrogen is consumed as completely as possible. This is accomplished by the following reactions:

$$CO + 3\,H_2 \rightarrow CH_4 + H_2O$$

$$CO_2 + 4\,H_2 \rightarrow CH_4 + 2\,H_2O.$$

A gas produced by cracking of evaporable hydrocarbons with water vapor on nickel-containing catalysts at temperatures above 450°C and under a pressure of 25 kilograms per square centimeter at a feedstock ratio of 2.5 kilograms water vapor per kilogram of hydrocarbons (boiling range 30°–110° C) has approximately the following composition on a dry basis:

| | |
|---|---|
| $CO_2$ | 23% by volume |
| CO | 1% by volume |
| $H_2$ | 18% by volume |
| $CH_4$ | 58% by volume |

The gas also contains 1.14 standard cubic meters of water vapor per standard cubic meter of gas.

This gas is in a thermodynamic equilibrium. To permit hydrogenation of the oxides of carbon until the hydrogen has been substantially consumed, the required thermodynamic conditions must be met by a reduction of the temperature, resulting in a change of the equilibrium constants, and/or by removing at least part of the water vapor. The difficulties which are involved in carrying out this methanation process are due to the extremely exothermic character of the above-mentioned hydrogenating reactions. 50 kilocalories of heat are liberated by the reaction of one mole $CO_2$ with 4 moles $H_2$. This means a liberation of 2 kilocalories by the reaction of 1 liter $CO_2$ (0° C., 760 millimeters mercury). In 1 standard cubic meter of rich gas of the above listed composition, the reaction of 10 liters carbon dioxide and 40 liters hydrogen results in a temperature rise of about 35°C. The temperature rise in the reaction mixture shifts the equilibria of the two hydrogenating reactions to the left, toward the starting materials, and may finally result in a higher heat loading of the catalyst. If the temperature-reducing action of water vapor is utilized by leaving it in the rich gas, as e.g., in the wet methanation described in DOS No. 1,645,840, the above-mentioned disadvantages must be accepted.

SUMMARY

It has been found that the liberation of heat caused by the two hydrogenating reactions described above may be controlled even in a rich gas which is dry or has a low water vapor content, if the rich gas has a hydrogen content below 15% by volume, particularly below 12% by volume, and the methanation is effected on a catalyst which is divided in two layers and in such a manner that the rich gas when it has been cooled to reduce its water vapor content, is fed in a branch stream heated to 250° C into the first catalyst layer whereas the other branch stream is fed between the two catalyst layers without having been preheated. This practice results in the formation of a gas mixture before the second catalyst layer and this gas mixture has a temperature between the temperature of the gas leaving the first catalyst layer and the temperature to which the rich gas has been cooled, and the water vapor content of the mixture lies between the water vapor contents of the unreacted and reacted branch streams respectively. The present invention relates to a process of producing a high-methane gas which can be used instead of natural gas by a hydrogenation of the oxides of carbon in a rich gas, which has been produced by a catalytic cracking of evaporable hydrocarbons with water vapor at elevated temperatures and pressures.

The process of the invention for producing high-methane gas includes the following steps:

a. catalytically cracking liquid hydrocarbons with water vapor at elevated temperatures and pressures to produce a rich gas containing less than 15% hydrogen by volume;
b. cooling the rich gas to a temperature below 150° C thereby reducing the water vapor content thereof by condensation;
c. separating condensed water from the rich gas;
d. thereafter dividing the rich gas into two streams and feeding same to a hydrogenation zone containing two catalyst layers
   i. one of said streams being preheated to a temperature of at least 250° C and then being fed to the first catalyst layer of said zone,
   ii. the other of said streams being fed between the catalyst layers of said zone; and
e. scrubbing the product gas leaving the hydrogenation zone to remove carbon dioxide.

DESCRIPTION OF THE DRAWING

The accompanying drawing is an illustrative flow diagram of a plant suitable for carrying out the process of the invention.

DESCRIPTION

The ratio of the two branch streams is preferably adjusted so that the temperature rise in the second catalyst layer is less than 50° C and the product gas leaving the second catalyst layer contains less than 1% by volume hydrogen. The branch stream flowing through both catalyst layers amounts suitably to 50–70% of the total stream.

The rich gas having a hydrogen content of up to 15% by volume, preferably below 12% by volume, is suitably produced by reacting liquid hydrocarbons having 3–15 carbon atoms, corresponding to a boiling range of about 30°–210° C, at temperatures of 480°–430° C and pressures above 30 kilograms per square centimeter with 1.5 to 2.7 kilograms water vapor per kilogram of hydrocarbon on a nickel-containing catalyst.

To methanate this rich gas, known hydrogenating catalysts which preferably contain nickel, may be used, for instance those catalysts which comprise nickel on an oxide or silicate support.

Referring to the drawing, a suitable plant includes a rich gas reactor 1, a methanation reactor 2 with catalyst layers 3 and 4, and a scrubber for removing carbon dioxide from the product gas leaving the methanation reactor. The scrubber includes an absorption tower 5 and a regenerating tower 6.

Hydrocarbon feedstocks, for instance gasoline, are fed through a conduit 7, evaporated in a heat exchanger 8, heated in another heat exchanger 9, and then combined in a conduit 13 leading to the rich gas reactor 1 with water vapor, which is fed in conduit 10 and heated in heat exchangers 11 and 12. The rich gas produced from the starting materials leaves the reactor 1 through conduit 14 and flows through heat exchanges 15 and 16. The gas is cooled below its dew point in the heat exchanger 16. Separated condensate (water) is withdrawn through conduit 17. Beyond heat exchanger 16, the gas stream from conduit 14 is branched into conduits 18 and 19. The branch stream in conduit 18 is passed through the heater 20 to the inlet side of the methanation reactor and flows through the first catalyst layer 3. The other branch stream is conducted through conduit 19 to a manifold 21 disposed between the two catalyst layers so that the two branch streams are combined before flowing through the second catalyst layer 4. The completely reacted mixture leaves the methanation reactor 2 through a conduit 22 and is cooled in a heat exchanger 23 and subsequently enters the absorption tower 5 of the scrubber in which the carbon dioxide is removed in known manner by scrubbing with an absorbent solution.

The purified product gas consists of almost pure methane and is supplied through a conduit 24 and, if desired, a cooler 25 to a consumer. The absorbent solution which has been laden with carbon dioxide in the absorption tower 5 is supplied in conduit 26, which incorporates a pressure relief valve 27, to the top of the regenerating tower 6 and is regenerated in that tower under a lower pressure, e.g., atmospheric pressure, by being heated in the reboiler 28 and/or by being stripped. The expelled carbon dioxide leaves the regenerating tower 6 through a conduit 29.

Regenerated absorbent solution is recycled to the top of the absorption tower 5 from the sump of the regenerating tower through a conduit 30 by means of a pump 31. The carbon dioxide may be removed in known manner by means of a hot concentrated potassium carbonate solution, which is laden under elevated pressure and is regenerated by being stripped with steam under atmospheric pressure. In the absorption and regenerating towers, the temperature of the solution is near its boiling point under atmospheric pressure. Other suitable absorbents are, e.g., high-boiling organic liquids having a solvent power for $CO_2$, e.g., propylene carbonate, N-methylpyrrolidone, Sulfolan, and the like, which are laden under superatmospheric pressure and at lower temperature, e.g., at ambient temperature, and are regenerated by being pressure-relieved and by being stripped with an inert gas. This stripping may also be carried out at the ambient temperature, if desired. In the cooling system represented by the cooler 23, the gas temperature is adjusted to the selected process of absorbing $CO_2$. In the heaters and coolers consisting of heat exchangers, the heat content of the product streams formed in the process may be utilized in a suitable manner. Additional heat exchangers, not shown, may be arranged at any desired points between which a sufficiently high temperature difference exists.

EXAMPLE 1000 kilograms gasoline (petrol) having a boiling range of 30°–180° C are evaporated and mixed with 2500 kilograms water vapor. The gasoline is evaporated under a pressure of 45 kilograms per square centimeter. The water vapor is supplied as superheated steam under a pressure of 50 kilograms per square centimeter. The mixture of gasoline and water vapors has a temperature of 400° C. The mixture is reacted in a reactor which contains 1 cubic meter of catalyst. The catalyst contains 40% by weight nickel on a magnesium silicate carrier and has been activated by a treatment with hydrogen before the reaction. 1753 standard cubic meters dry gas and 2295 standard cubic meters water vapor are discharged from the reactor. The gas has the following composition:

23.2% by volume $CO_2$
0.2% by volume CO
9.7% by volume $H_2$
66.9% by volume $CH_4$ The gas is cooled to 120° C by a heat exchange, whereby a major part of the water vapor is condensed so that the 1753 standard cubic meters dry rich gas contain only 87 standard cubic meters water vapor. The rich gas is divided such that 1070 standard cubic meters of the gas in 18 are heated by 20 to 280° C and are reacted in reactor 2 on 140 liters of a nickel-containing catalyst 3. The catalyst used in this stage contains nickel on an oxide carrier and consists of 22% by weight nickel, 48% by weight $Al_2O_3$, 7% by weight CaO and 23% by weight MgO. The reaction taking place on catalyst 3 results in a temperature rise from 280° to 360° C. The gas being discharged has the following composition:

23.1% by volume $CO_2$
0.1% by volume CO
0.9% by volume $H_2$
73.9% by volume $CH_4$ The water vapor content of the gas has increased from 0.0495 standard cubic meter per standard cubic meter (87 standard cubic meters water vapor per 1753 standard cubic meters of dry gas) to 0.102 standard cubic meter per standard cubic meter.

The remaining 683 standard cubic meters rich gas in 19 at 120° C are admixed to the gas discharged from the first catalyst layer 3. The resulting mixture has a temperature of 270° C and the following composition:

23.2% by volume $CO_2$
0.2% by volume CO
4.6% by volume $H_2$
72.0% by volume $CH_4$ This gas is further reacted in a second catalyst layer 4, which contains 250 liters of the catalyst used in the first layer. From this second layer 4 exits 167 standard cubic meters water vapor and 1590 standard cubic meters dry gas having a temperature of 300° C and the following composition:

23.2% by volume $CO_2$
0.4% by volume $H_2$
76.4% by volume $CH_4$

In a packed column 5, 5 meters high, the gas is scrubbed at 115° C with an aqueous solution containing 30% by weight potash to remove the carbon dioxide from the gas. The gas leaving column 5 is cooled and constitutes 1235 standard cubic meters dry gas containing 0.9% by volume $CO_2$
0.5% by volume $H_2$
98.5% by volume $CH_4$

I claim:

1. Process for producing high-methane gas which comprises:

a. catalytically cracking liquid hydrocarbons with water vapor at elevated temperatures and pressures to produce a rich gas containing less than 15% hydrogen by volume;
b. cooling the rich gas below its dew point to a temperature below 150°C thereby reducing the water vapor content thereof by condensation;
c. separating condensed water from the rich gas;
d. thereafter dividing the rich gas into two streams and feeding same to a hydrogenation zone containing two catalyst layers,
   i. one of said streams being preheated to a temperature of at least 250°C and then being fed to the first catalyst layer of said zone, said one stream constituting 50–70% of the total rich gas,
   ii. the other of said streams being fed between the catalyst layers of said zone without preheating where it is mixed with the gas discharged from the first catalyst layer thereby cooling same and thereafter further reacting said mixture in the second catalyst layer thereby producing a product gas; and
e. scrubbing the product gas leaving the hydrogenation zone to remove carbon dioxide.

2. Process of claim 1 wherein the ratio of said two streams is adjusted such that the temperature rise in the second catalyst layer of the hydrogenation zone is less than 50° C and the product gas leaving the hydrogenation zone contains less than 1% hydrogen by volume.

3. Process of claim 1 wherein a rich gas containing less than 12% hydrogen by volume is produced in step (a) by cracking a liquid hydrocarbon containing 3 to 15 carbon atoms and boiling in the range of about 30°–210° C, at a temperature of about 480°–430° C and a pressure greater than 30 kilograms per square centimeter in the presence of a nickel-containing catalyst using from 1.8 to 2.7 kilograms of water vapor per kilogram of said liquid hydrocarbon.

* * * * *

UNITED STATES PATENT AND TRADEMARK OFFICE

CERTIFICATE OF CORRECTION

PATENT NO. : 4,012,404

DATED : March 15, 1977

INVENTOR(S) : Helmut Liebgott

It is certified that error appears in the above-identified patent and that said Letters Patent are hereby corrected as shown below:

TITLE AND ABSTRACT PAGE, line 17 - after 'being fed at the' "temperatures" should read -- temperature--.

Column 4, line 67 - the "o" in "boiling" is not clear.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*